US010183324B2

(12) United States Patent
Howard

(10) Patent No.: US 10,183,324 B2
(45) Date of Patent: Jan. 22, 2019

(54) VENTED SAND CORE FOR SAND CASTING

(71) Applicant: Rolls-Royce Corporation, Indianapolis, IN (US)

(72) Inventor: Douglas Walter Howard, Knightstown, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 15/097,908

(22) Filed: Apr. 13, 2016

(65) Prior Publication Data

US 2017/0297089 A1 Oct. 19, 2017

(51) Int. Cl.

| | |
|---|---|
| ***B22C 9/10*** | (2006.01) |
| ***B22D 25/02*** | (2006.01) |
| ***B22C 9/02*** | (2006.01) |

(52) U.S. Cl.

CPC ..... *B22C 9/106* (2013.01); *B22C 9/02* (2013.01); *B22D 25/02* (2013.01)

(58) Field of Classification Search

CPC .. B22C 9/10; B22C 9/108; B22C 9/02; B22C 9/106; B22D 25/02

USPC ..... 164/15, 34, 369

See application file for complete search history.

(56) References Cited

U.S. PATENT DOCUMENTS

| | | | | |
|---|---|---|---|---|
| 2,991,520 | A * | 7/1961 | Dalton | B22C 9/106 164/131 |
| 3,037,252 | A | 6/1962 | House et al. | |
| 3,624,758 | A | 11/1971 | Harris | |
| 3,644,269 | A | 2/1972 | Hoyt et al. | |
| 3,945,429 | A | 3/1976 | Wahlqvist | |
| 4,651,799 | A | 3/1987 | Chandley | |
| 4,655,276 | A | 4/1987 | Bird et al. | |
| 4,711,289 | A | 12/1987 | Kanoh et al. | |
| 7,044,190 | B2 | 5/2006 | Nakai et al. | |
| 7,096,919 | B2 | 8/2006 | Narushima et al. | |
| 2015/0053365 | A1 | 2/2015 | Mueller et al. | |

FOREIGN PATENT DOCUMENTS

| | | | | |
|---|---|---|---|---|
| CN | 101362189 A | * | 2/2009 | B22C 9/10 |

OTHER PUBLICATIONS

Machine translation of CN 101362189 A.*

* cited by examiner

*Primary Examiner* — Kevin P Kerns

(74) *Attorney, Agent, or Firm* — Shumaker & Sieffert, P.A.

(57) ABSTRACT

In one example, a sand core for use in a sand casting process includes a core body including a sand composition, the sand composition including sand and a binder; and a burnable fuse extending within the core body along a path and out of a surface of the core body, wherein the burnable fuse is configured such that when the fuse is ignited, the fuse burns within the core body to substantially remove the fuse and form a venting tunnel along the path within the core body with an opening in the surface.

22 Claims, 9 Drawing Sheets

VENTED SAND CORE FOR SAND CASTING

TECHNICAL FIELD

The disclosure relates to sand cores, e.g., used in sand metal casting.

BACKGROUND

Metal casting involves pouring molten metal or alloy into a mold, and allowing the poured molten material to cool and solidify into an object shaped by the mold. The object may be retrieved from the mold, for example, by breaking or disassembling the mold. Sand casting is a type of metal casting that employs sand as part of the material defining the mold.

SUMMARY

In one example, a sand core for use in a sand casting process, the sand core comprising a core body comprising a sand composition, the sand composition including sand and a binder; and a burnable fuse extending within the core body along a path and out of a surface of the core body, wherein the burnable fuse is configured such that when the fuse is ignited, the fuse burns within the core body to substantially remove the fuse and form a venting tunnel along the path within the core body with an opening in the surface.

In another example, a sand core for use in a sand casting process, the sand core comprising a core body comprising a sand composition, the sand composition including sand and a binder; and a venting tunnel extending along a path within the core body and defining an opening in a surface of the core body, wherein the venting tunnel is formed by burning a burnable fuse extending within the core body along the path and out of the surface of the core body.

In another example, a method comprising depositing a sand composition to form a first portion of a sand core body, wherein the sand composition includes sand and a binder; depositing a burnable fuse on the first portion of the sand core body along a path; and depositing the sand composition over the burnable fuse and first portion to form a second portion of the sand core body, wherein the first portion and the second portion to form the core body and the burnable fuse extends along the path within the core body and out of a surface of the core body.

The details of one or more examples are set forth in the accompanying drawings and the description below. Other features, objects, and advantages will be apparent from the description and drawings, and from the claims.

DETAILED DESCRIPTION

Figure 1:
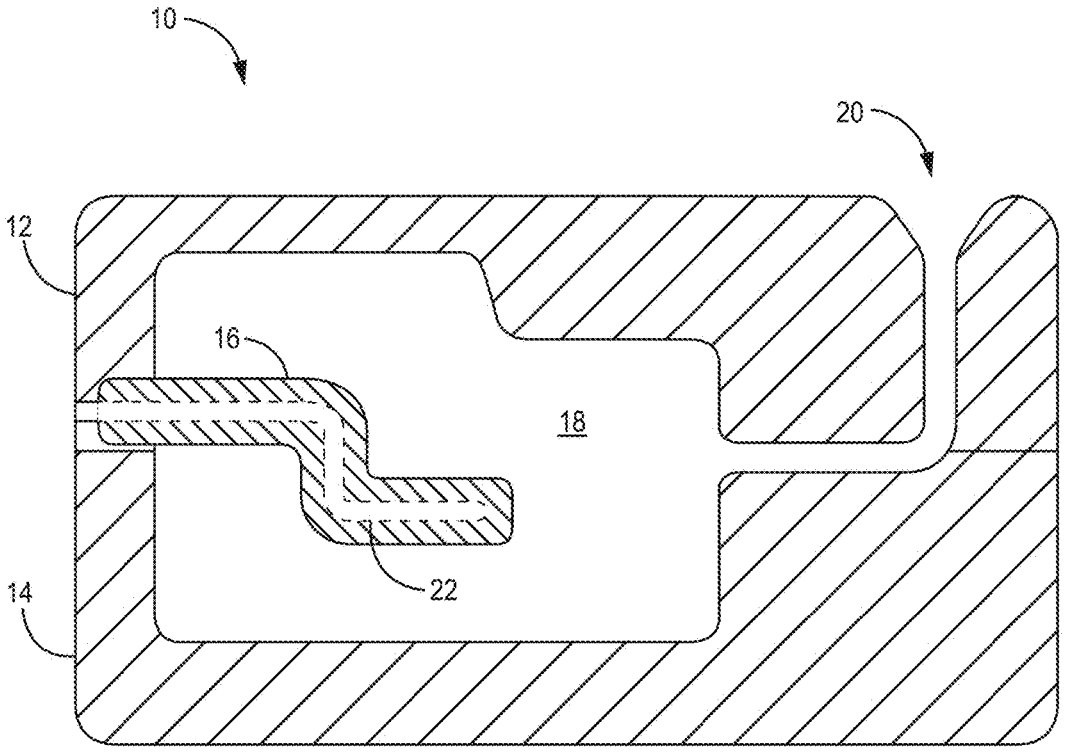
FIG. 1 is a conceptual diagram illustrating an example sand casting apparatus including an example sand core with a venting tunnel.

The disclosure describes example systems and techniques for sand casting of a metal or metal alloy. Sand casting may utilize expendable sand molds to form complex metal parts that can be made of a variety of metals or metal alloys. In some examples, sand casting of a metal or metal alloy includes pouring molten metal or metal alloy into a mold cavity defined by a sand mold to fill the cavity and then cooling the molten metal or metal alloy in the mold cavity to allow the metal or metal alloy to solidify. Once the metal or metal alloy in the mold cavity has solidified, the solidified casting may be removed from the mold cavity to produce a cast metal or metal alloy component.

In such a sand casting process, the shape of the mold cavity may define the external geometry of the cast component. In some examples, one or more sand cores may be positioned within the mold cavity prior to filling the cavity with molten metal or metal alloy. When the cavity is filled with molten metal or metal alloy, the molten material may surround all or portion of the sand core within the mold cavity. In this manner, the sand core(s) may define the internal geometries of one or more portions of the resulting cast component.

The body of a sand core may be defined by a sand composition including sand and a binder (e.g., a two part epoxy) to help maintain the shape of the sand core. For example, sand and liquid binder may be mixed to form a moist sand composition that is molded into the desired shape and then cured to form a sand core. While the sand of the sand composition may be relatively resistant to the high temperatures during the sand casting process when the molten metal is introduced into the mold cavity, in some examples, the binder may burn off or otherwise generates a gas when the molten material contacts the sand core.

In some instances, the gas generated from the sand core during the sand process may transfer from the sand core into the molten metal within the mold cavity resulting in one or more gas pockets in the cast metal or metal alloy component.

In accordance with one or more examples of the disclosure, a sand core may be formed with a venting tunnel extending within the core body by placing a burnable fuse within the core body, e.g., while the core body is being molded, with a portion of the venting fuse extending out of the surface of the core body. Prior to using the sand core in a sand casting process, the burnable fuse may be ignited such that the burnable fuse burns within the core body. Once the fuse has burned, the volume previously occupied by the fuse may form an open tunnel within the core along the path of the burnable fuse with an opening out of the core body. In this manner, a sand core may be formed with a venting tunnel within the core body for venting of gas generated within the sand core when exposed to a molten metal during a sand casting process.

As described herein, some examples of the disclosure may provide for one or more advantages, e.g., as compared to other techniques employed to provide venting of gas from the core body of a sand core. For example, a burnable fuse may be relatively flexible, allowing for the fuse to assume a variety of geometrical paths (e.g., nonlinear geometrical paths) within the core body, thus, allowing for venting tunnels that exhibit a variety of such geometrical paths. In this way, the burnable fuse may facilitate formation of complex geometrical paths within the core body without requiring the connection of a series linear passageways which are individually drilled in combination with the plugging of one or more openings formed by the multiple drilling to form a single continuous venting tunnel within the core body. Moreover, the use of a burnable fuse to form a venting tunnel may reduce or substantially prevent the clogging or otherwise blocking of the resulting venting tunnel at one more points along the length of the tunnel, e.g., as may occur with a mesh tube.

FIG. 1 is a conceptual and schematic diagram illustrating an example apparatus 10 for sand casting a molten metal or metal alloy into a cast component. FIG. 1 illustrates a cross-sectional view of apparatus 10 to illustrate the internal configuration of the sand casting apparatus. Sand casting is a process that may be used to produce a wide variety of metal components with complex geometries. These parts can vary greatly in size and weight, ranging, e.g., from a couple ounces to several tons. Example components may include, but are not limited to, aluminum or magnesium gear boxes, housings, covers, pumps, air inlets, or the like. Such components may need one or more internal passages to function properly.

For ease of illustration, sand casting apparatus 10 shown in FIG. 1 is a relatively simple example of a sand casting apparatus that employs one or more sand cores 16. However, examples of the disclosure of are not limited to that of apparatus 10 shown in FIG. 1 but instead may include any suitable sand casting apparatus or system that employs sand cores which may benefit from venting tunnels to vent gas from the sand cores during a sand casting process.

As shown, apparatus 10 includes upper mold portion 12 and lower mold portion 14 (which may be referred to in some instances as the cope and drag, respectively). Upper mold portion 12 and lower mold portion 14 may each be formed according to a desired geometry, e.g., by packing sand within a box (which may be referred to as a flask) around a pattern that is the replica of the external shape of the desired casting. The upper mold portion 12 and lower mold portion 14 may be stacked and clamped together as shown in FIG. 1 to form mold cavity 18. When stacked as shown FIG. 1, a molten metal or metal alloy may be poured into opening 20, which then flows into mold cavity 18. Once the metal or metal alloy has cooled and solidified, the cast component may be removed from mold cavity 18, e.g., by using a shake-out or other suitable processes. Subsequently, unwanted excess material may be trimmed from the casting.

The inner surfaces of mold cavity 18 formed by upper mold portion 12 and lower mold portion 14 may define the external geometry of a component cast in mold cavity 18. As shown in FIG. 1, apparatus 10 also includes sand core 16 within mold cavity 18 which may be formed separate from upper mold portion 12 and lower mold portion 14.

Figure 2:
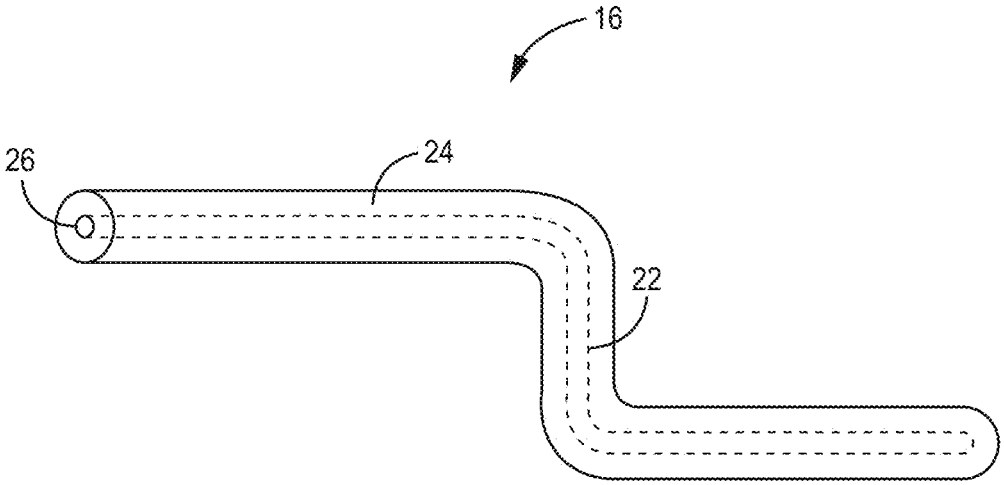
FIG. 2 is a conceptual diagram illustrating the example sand core of FIG. 1.

FIG. 2 is a conceptual diagram illustrating sand core of FIG. 1 shown separate from upper mold portion 12 and lower mold portion 14. As shown, sand core 16 includes core body 24 and a venting tunnel 22 which extends through core body 24 to an opening 26 in core body 24.

Sand core 16 may be used to form internal features of a cast component when a molten metal or metal alloy fills around sand core 16 within mold cavity 18. For example, sand core 16 may be an additional piece that forms internal holes and passages of a casting formed in cavity 18. Sand core 16 may be formed of a composition including sand so that core body 24 of sand core 16 may be shaken out of the casting, rather than require the necessary geometry to slide out. As a result, sand core 16 allows for the fabrication of many complex internal features. Sand core 16 may be positioned in mold 10 before the molten metal is poured into cavity 18. In order to keep sand core 16 in place, the pattern formed by upper mold portion 12 and lower mold portion 14 may define a recess called a core print where sand core 16 can be anchored in place. In some examples, sand core 16 may still shift due to buoyancy in the molten metal. Further support may be provided to sand core 16, e.g., by chaplets, which may be small metal pieces that are fastened between sand core 16 and a surface of mold cavity 18. In some examples, chaplets or other supports may be made of a metal with a higher melting temperature than that of the metal being cast in order to maintain their structure during the casting process.

While sand core 16 is shown having a tubular shape extending in a zig-zag manner with two approximately 90 degree turns, sand core 16 may exhibit any suitable shape that produces the desired internal features of metal or metal alloy component cast within mold cavity 18. In some example, sand core 16 may be shaped and positioned within cavity 18 to produce a casting with more twists and turns in its internal passages. For example, these passages may be oil or cooling line passages cast into the component.

Core body 24 of sand core 16 may be formed of a sand composition including sand and a binder to help maintain the shape of sand core 16 when molded into a desired shape. In some examples, to mold core body 24 into a desired shape, a mixture of sand and liquid binder may be placed in a mold or otherwise shaped as desired. The binder may then cure or harden to hold the shape of core body 24. Any suitable sand and binder that allows for core body 24 to be formed with a desired shape and function as described herein in sand casting apparatus 10 may be used. The sand in the sand composition may have a melting temperature greater than the temperature of the molten metal or metal alloy poured into mold cavity 18 of apparatus such that core body 24 does not melt during the sand casting process. Example sands that may be used in the sand composition for core body 24 include silica, fused silica, chromite, zirconium, spherechrome sand, and the like, and may be, e.g., round and/or subangular grains. Moreover, there are many synthetic sand blends that may also be used with this process. Example binders that may be used include, but are not limited to, epoxies (e.g., two-part epoxy systems) furan, acrylic epoxy, phenolic urethane, clays (e.g., bentonite) and the like.

In some examples, the binder may burn or otherwise generate a gas at the relatively high temperatures resulting from the exposure to the molten metal or metal alloy within mold cavity 18 during the sand casting process. As such, sand core 16 includes venting tunnel 22 which is shown in FIG. 2 as extending through core body 24 to opening 26 in the surface of core body 24. During the sand casting process, gas generated within core body 24 may be vented out via venting tunnel 22 rather than through the outer surface of core body 24. In the configuration shown in FIG. 1, opening 26 of venting tunnel 22 is positioned such that any gas vented out of opening 26 is directed out of mold cavity 18 rather than into mold cavity 18. In this manner, when mold cavity 18 is filled with molten metal or metal alloy, gas generated by sand core 16 does not vent into the molten metal or metal alloy but is instead directed away from the molten material, e.g., to reduce or substantially prevent defects in the resulting cast component caused by the presence of gas pockets within the cast components. The dimensions of venting tunnel 22 may be such that the flow of generated gas is not constricted during the casting process, e.g., the tunnel is sufficiently sized to handle the volumetric flow rate of gas generated during the casting process.

Figure 3:
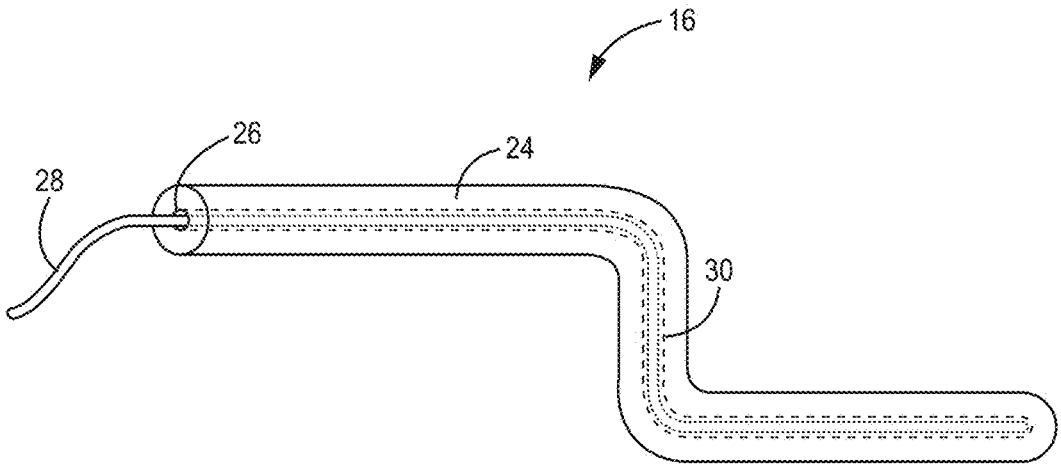
FIG. 3 is a conceptual diagram illustrating the example sand core of FIG. 2 including a burnable fuse prior to being burned to form a venting tunnel.

FIG. 3 is a conceptual diagram illustrating the example sand core of FIG. 2 including burnable fuse 28 prior to burnable fuse 28 being burned to form venting tunnel 22 in the configuration shown in FIG. 2. As noted above, rather than drilling venting tunnel 22 into core body 24 after core body 24 has been molded into a desired shape, venting tunnel 22 may be formed by placing burnable fuse 28 within core body 24 during the molding process. As shown in FIG. 3, burnable fuse 28 extends within core body 24 along path 30 which corresponds to the path of venting tunnel 22 after burnable fuse 28 is burned within core body 24. In the configuration shown, path 30 of burnable fuse 28 runs along substantially the center of core body 24. The shape of sand core 16 is non-linear over its length (e.g., including two approximately 90 degrees turns) and burnable fuse 28 follows a non-linear path 30 as well. In other examples, fuse 28 may follow a substantially linear path 30 to form a substantially linear venting tunnel 22, e.g., when sand core 16 is substantially linear in shape.

A portion of burnable fuse 28 extends out of the surface of core body 24 at opening 26. This exposed portion of burnable fuse allows for the portion to be ignited so that burnable fuse may be burned along path 30 within core body 24. The burning of fuse 28 may propagate along the length of fuse 28 such that fuse 28 burns along the entire length of path 30 within core body 24. The burning of fuse 28 may consume the mass (or at least a portion thereof) of fuse 28 to leave a void space in core body 24. Once burned, the volume of sand core 16 previously occupied by burnable fuse 28 defines an open passageway forming venting tunnel 22.

Although burnable fuse 28 is shown being positioned within core body 24 such that only a single open passageway is formed with a single opening 26 in the surface of core body 24, other configurations are contemplated. For example, one or more fuses may be positioned within core body 24 such that one or more venting tunnels each with one or more openings in the surface of core body 24 are formed upon burning burnable fuse 28.

Any suitable fuse type may be used to form burnable fuse 28. Fuse 28 may be formed of one or more materials that allow the fuse to burn within core body 24, which may be a relatively low oxygen environment, without extinguishing. In this manner, substantially all of the portion of fuse 28 within core body 24 may be burned and consumed to form venting tunnel 22 along substantially all of path 30, e.g., as compared to only burning a portion of fuse 28 along path 30. In some examples, burnable fuse 28 may include a suitable fuel source and oxidizer such that burnable fuse 28 burns along substantially the entire length within core body 24. The oxidizer may be required to allow burnable fuse 28 to burn even in a relatively low oxygen environment within core body 24.

In some examples, burnable fuse 28 may include black powder, which may be a mixture of sulfur, charcoal, and potassium nitrate. The sulfur and charcoal act may act as fuels, and the potassium nitrate as an oxidizer. In one example, burnable fuse 28 may be a visco-type fuse having a core of black powder or other oxidant with one or more textile overwraps. In some examples, the fuse may include a first layer of string wound around the core and a second layer of string wound in the opposite direction of the first layer to prevent unraveling. A fuse including one or more outer layers may be coated with wax or nitrocellulose lacquer for water resistance and/or to keep the fuse from falling apart. However, any suitable fuse may employed that allows burnable fuse 28 to function as described herein to form venting tunnel 22 in core body 24.

Burnable fuse 28 may exhibit one or more properties that allow for the formation of a suitable venting tunnel 22. For example, burnable fuse 28 may be flexible such that fuse 28 may follow a non-linear path 30 within core body 24, e.g., as shown in FIG. 3. Fuse 28 may have a length that allows for fuse to extend along path 30 to form venting tunnel 22 of a desired length and so that fuse 28 extends out of a surface of core body 24. The diameter of burnable fuse 28 may be selected such that the diameter of venting tunnel 22 after fuse 28 is burned within core body 24 allows for venting of gas formed during the casting process. If the diameter of fuse 28 is too small, the void space left after burning fuse 28 may not form a continuous tunnel but instead may be filled with ash or other material left over after fuse 28 has burned. In some examples, the diameter of burnable fuse 28 may be greater than approximately 1.5 millimeters, e.g., approximately 2 millimeters to approximately 3 millimeters. Other diameters are contemplated.

Fuse 28 may be configured to burn along its length at a suitable rate, e.g., in term of feet per second, and temperature. In some examples, fuse 28 may be configured to burn at a rate of approximately 1 foot per minute or greater, such as, e.g., approximately 1 foot per minute to approximately 2 feet per minute. If the burn rate is too high, fuse 28 may be too combustible, which may cause core body 24 to burst or otherwise fall apart when fuse 28 burns. If fuse 28 burns at too high a temperature and/or too slowly, the binder in core body 24 may melt and burn, causing the bound sand to fall apart. For example, in some instances fuse 28 may burn at a temperature that is higher than the melting point of the binder of core body 24. In one example, the melting temperature of the binder may be approximately 450 degrees Fahrenheit (approximately 232.2 degrees Celsius). In such instances, it is important that fuse 28 does not burn too slowly as to break down the binder throughout the entire core body 24. However, there may be a heat affected zone in core body 24 directly adjacent fuse 28 in which the binder will breakdown locally within core body 24. Such a zone may enhance the venting of the resulting venting tunnel, e.g., by breaking down the binder in core body 24 adjacent to fuse 28, which increases the diameter of the venting tunnel. Such a mechanism is similar to that of burning a fuse through an ice cube in which the burning melts the ice cube in the areas adjacent to the fuse but not the entire cube.

Figure 4:
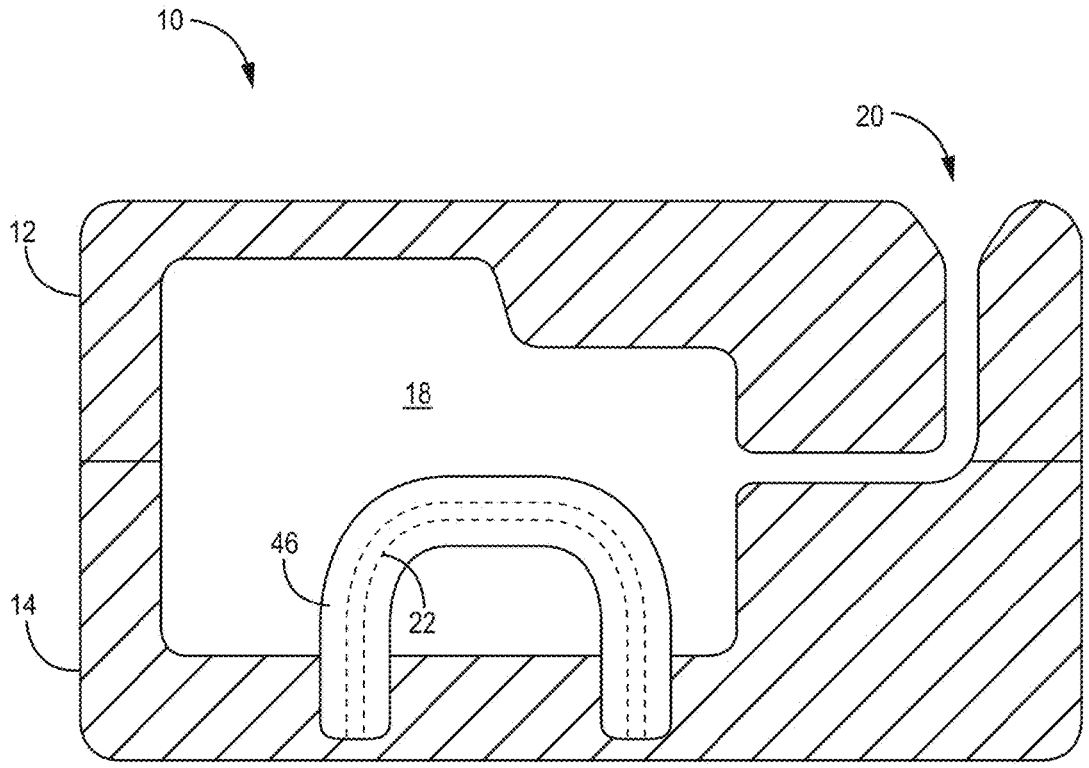
FIG. 4 is a conceptual diagram illustrating an example sand casting apparatus including another example sand core with a venting tunnel.
Figure 5:
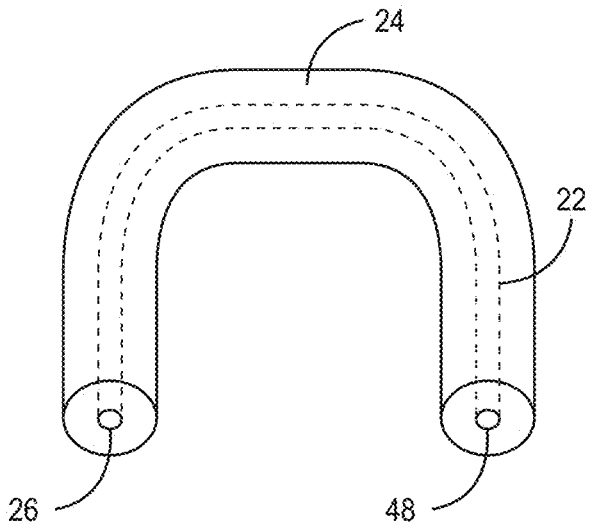
FIG. 5 is a conceptual diagram illustrating the example sand core of FIG. 4.
Figure 6:
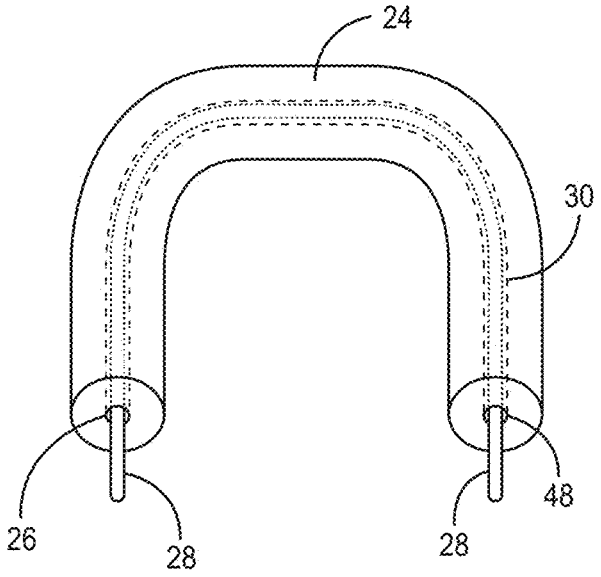
FIG. 6 is a conceptual diagram illustrating the example sand core of FIG. 5 including a burnable fuse prior to being burned to form a venting tunnel.

FIG. 4 is a conceptual diagram illustrating example sand casting apparatus 10 including another example sand core 46 with a venting tunnel 22. FIG. 5 is a conceptual diagram illustrating the example sand core of FIG. 4. FIG. 6 is a conceptual diagram illustrating the example sand core of FIG. 5 including a burnable fuse prior to being burned to form a venting tunnel.

Sand core 46 show in FIGS. 4-6 may be substantially the same as that of sand core 16 shown in FIGS. 1-3. However, as shown in FIG. 6, fuse 28 extends all the way through core body 24 along path 30 compared to sand core 16 in which fuse 28 does not extend all the way through core body 24. In this manner, venting tunnel 22 formed by the burning of fuse 46 is an open passage within core body 24 extending from opening 26 to opening 48. Gas generated during the casting process may flow out of either opening 26 or opening 48 rather than into cavity 18.

Figure 7:
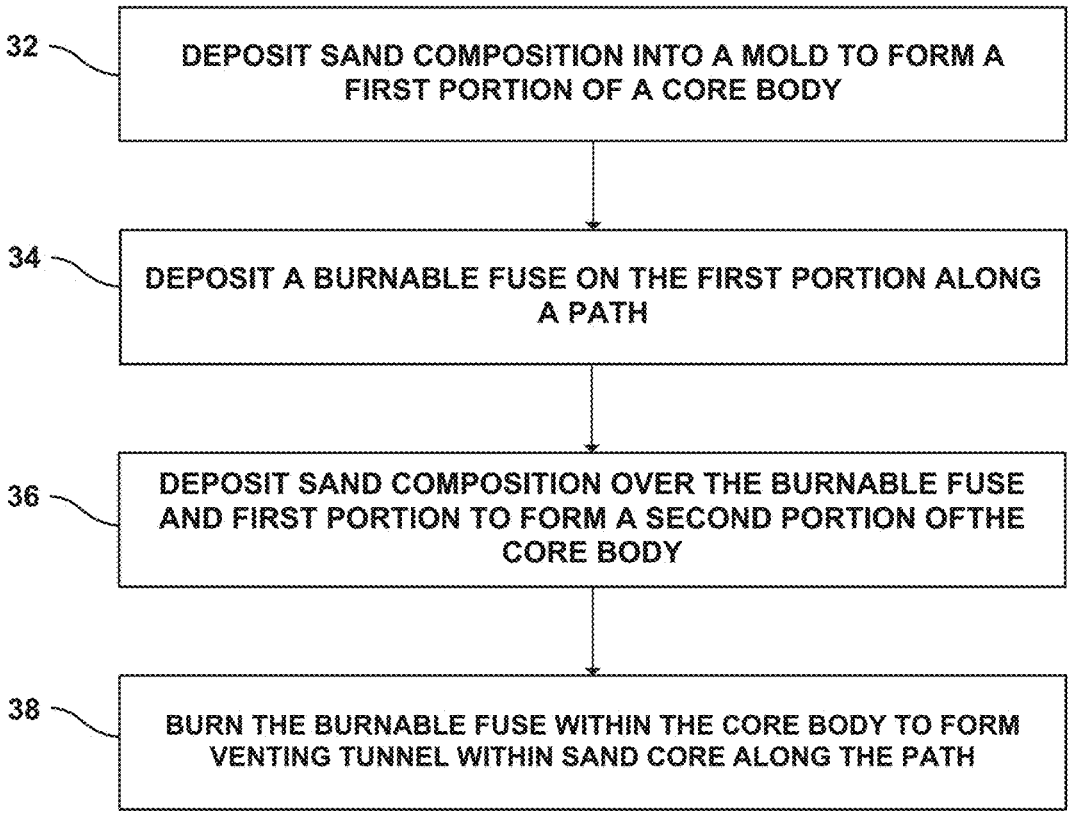
FIG. 7 is a flow diagram illustrating an example technique for forming a sand core in accordance with an example of the disclosure.

FIG. 7 illustrates a flow diagram of an example technique for forming a vented sand core for use in a sand casting process. The technique of FIG. 2 will be described with regard to sand core 16 of FIGS. 1-3. However, it will be understood that other suitable techniques may be used and other suitable sand cores may be fabricated, such as, e.g., sand core 46 of FIGS. 4-6.

As shown in FIG. 7, a sand composition may be deposited in to mold to form a first portion of core body 24 (32). For example, the cavity of a mold may be filled partially (e.g., approximately half filled) with the sand composition to form a lower portion of core body 24 in the mold. The sand composition may include a sand and a binder, e.g., a liquid binder. Subsequently, burnable fuse 28 may be deposited, e.g., by hand, on the upper surface and/or embedded in the upper surface of the deposited sand composition in the mold that forms the first portion of core body 24 in the mold (34). Burnable fuse 28 may be deposited along a desired path 30, e.g., along substantially the center line of the upper surface of the sand composition in the mold and such that a portion of the fuse extends away from the upper surface.

Once burnable fuse 28 has been deposited, additional sand composition may be deposited in the cavity of the mold over burnable fuse and the sand composition previously deposited in the mold (36). The binder may then be allowed to harden or cure, at which point the formed core body 24 with burnable fuse 28 embedded within core body 28 may be removed from the mold. Burnable fuse 28 may then be burned along substantially the entire length of fuse 28 within core body 24, e.g., by igniting an exposed portion of fuse 28 with heat/flame and allowing the burning to propagate along the length of fuse 28 within core body 24 (38). In this manner, venting tunnel 22 may be formed within core body 28. As described herein, the resulting vented sand core 16 may be utilized in a sand casting process in which molten metal or metal alloy is poured around a portion of sand core 16 to form a cast component as described herein.

Examples

Various examples of a sand core were fabricated in accordance with one or more examples of the disclosure and then evaluated. In one example, a sand core having a "U" shape and overall length of approximately 12 inches was formed in a mold with a burnable fuse extending within substantially the center of the sand core. The burnable fuse extended into the first end of the sand core and out of the second end. The sand composition used to form the core body included fused silica sand with phenolic urethane binder, which was air set. The burnable fuse was a visco-type fuse having a black powder core. The fuse had a diameter of approximately 3 millimeters. The diameter of the core body was approximately 6.35 millimeters (250 mils)

Figure 8:
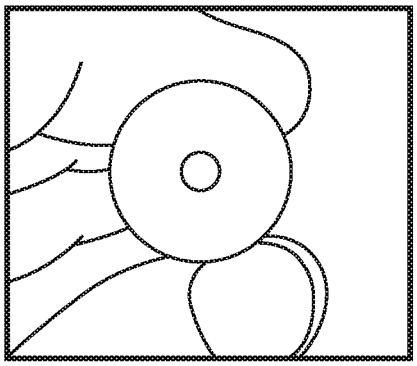
FIGS. 8 and 9 are photographs of an example sand core fabricated for evaluation.
Figure 9:
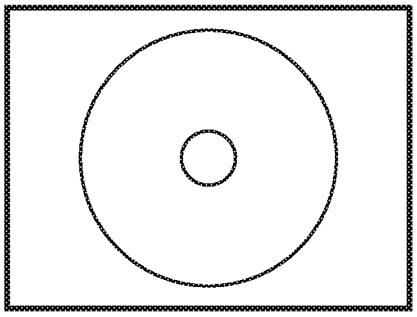

Upon forming the core body, the visco-type fuse was ignited at one end with a flame. The fuse burned along its length within the sand core body and out to the second end at a rate of approximately 1 foot per 30 seconds. The burning of the fuse resulted in a tunnel that extended continuously through the sand core body with opening were the fuse extended into and out of the core body. FIGS. 8 and 9 are photographs of the sand core after the fuse was burned showing the openings formed in the sand core body by burning the fuse to substantially remove the fuse. The continuous nature of the tunnel was verified by sending a gas (smoke) through one end of the tunnel and was observed exiting out the other end.

In another example, a similar example sand core was formed with a 1.5 millimeter visco-type fuse. The fuse was ignited and burned. However, the ash from the burned fuse filled the pathway formerly occupied by the fuse at one or more points within the sand core rather than allowing for a continuous venting tunnel.

Figure 10A:
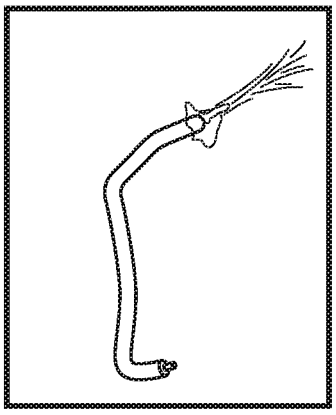
FIGS. 10*a*-10*c* are photographs of a burnable fuse at various stages burning through a sand core to create a venting tunnel.
Figure 10B:
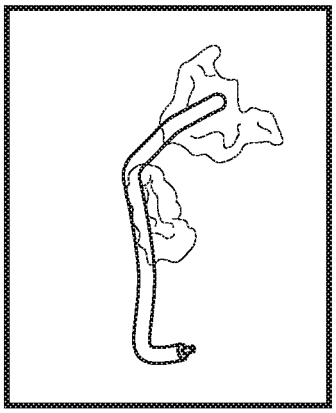
Figure 10C:
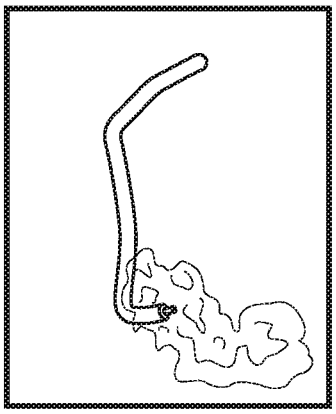

Another example sand core with burnable fuse was formed. The fuse extended into the first end of the sand core and out of the second end. The sand composition used to form the core body included fused silica sand with a furan binder, which underwent sulfur dioxide curing. The burnable fuse was a visco-type fuse with a diameter of approximately 3 millimeters. The diameter of the core body was approximately 12.7 millimeters (500 mils). The fuse was ignited and burned from end to end to form a venting tunnel within the sand core. FIGS. 10*a*-10*c* are photographs of the visco-type fuse burning within the sand core.

Various examples have been described. These and other examples are within the scope of the following claims.

The invention claimed is:

1. A precursor sand core for use in a sand casting process, the precursor sand core comprising:

a core body comprising a sand composition, the sand composition including sand and a binder; and a burnable fuse extending within the core body along a path and out of a surface of the core body, wherein the burnable fuse is configured such that when the fuse is ignited, the fuse burns and the burning propagates along a length of the fuse within the core body to substantially remove the fuse to form a venting tunnel along the path within the core body with an opening in the surface, wherein the burnable fuse is configured to burn at approximately 1 foot per minute or greater when ignited.

2. The precursor sand core of claim 1, wherein the venting tunnel is configured such that gas generated within the core body during a sand casting process using the sand core escapes the core body via the venting tunnel.

3. The precursor sand core of claim 1, wherein the path of the burnable fuse is non-linear.

4. The precursor sand core of claim 1, wherein the burnable fuse is configured to burn along substantially an entire length of the burnable fuse within the core body.

5. The precursor sand core of claim 1, wherein the burnable fuse comprises a black powder core and at least one outer layer around the black powder core.

6. The precursor sand core of claim 1, wherein the venting tunnel has substantially a same diameter as the burnable fuse.

7. The precursor sand core of claim 1, wherein the path of the burnable fuse extends in substantially a center of the core body.

8. The precursor sand core of claim 1, wherein the burnable fuse extends out of the surface at a first location and a second location such that the venting tunnel formed by burning the fuse includes two separate openings in the surface.

9. The precursor sand core of claim 1, wherein the burnable fuse exhibits a diameter of greater than approximately 1.5 millimeters.

10. The precursor sand core of claim 1, wherein the burnable fuse comprises a fuel source and an oxidizer.

11. The precursor sand core of claim 1, wherein the burnable fuse is configured to burn at approximately 1 foot per minute to approximately 2 feet per minute when ignited.

12. A method comprising:

depositing a sand composition to form a first portion of a sand core body, wherein the sand composition includes sand and a binder;

depositing a burnable fuse on the first portion of the sand core body along a path;

depositing the sand composition over the burnable fuse and first portion to form a second portion of the sand core body, wherein the first portion and the second portion to form the core body and the burnable fuse extends along the path within the core body and out of a surface of the core body; and igniting the burnable fuse such that the fuse burns at approximately 1 foot per minute or greater and the burning propagates along a length of the fuse within the sand core body to substantially remove the fuse to form a venting tunnel along the path within the sand core body with an opening in the surface.

13. The method of claim 12, further comprising pouring a molten metal around a portion of the sand core body, wherein gas generated within the sand core body while the molten metal is around the portion of the sand core body escapes the sand core body via the venting tunnel rather than into the molten metal.

14. The method of claim 12, wherein igniting the burnable fuse comprises burning the burnable fuse along substantially an entire length of the burnable fuse within the sand core body.

15. The method of claim 12, wherein the venting tunnel has substantially a same diameter as the burnable fuse.

16. The method of claim 12, wherein the path of the burnable fuse is non-linear.

17. The method of claim 12, wherein the burnable fuse comprises a black powder core and at least one outer layer around the black powder core.

18. The method of claim 12, wherein the path of the burnable fuse extends in substantially a center of the sand core body.

19. The method of claim 12, wherein the burnable fuse extends out of the surface at a first location and a second location such that the venting tunnel formed by burning the fuse includes two separate openings in the surface.

20. The method of claim 12, wherein the burnable fuse exhibits a diameter of greater than approximately 1.5 millimeters.

21. The method of claim 12, wherein the burnable fuse comprises a fuel source and an oxidizer.

22. The method of claim 12, wherein igniting the burnable fuse such that the fuse burns at approximately 1 foot per minute or greater comprises igniting the burnable fuse such that the fuse burns at approximately 1 foot per minute to approximately 2 feet per minute.

* * * * *